United States Patent [19]

Ericsson

[11] Patent Number: 4,744,682

[45] Date of Patent: May 17, 1988

[54] NEEDLE PRINTING HEAD

[75] Inventor: Per E. Ericsson, Bromma, Sweden

[73] Assignee: U.S. Philips Corporation, New York, N.Y.

[21] Appl. No.: 62,922

[22] Filed: Jun. 16, 1987

[30] Foreign Application Priority Data

Jun. 18, 1986 [SE] Sweden ..... 8602718

[51] Int. Cl.[4] ..... B41J 3/12

[52] U.S. Cl. ..... 400/124; 101/93.05

[58] Field of Search ..... 400/121, 124; 101/93.04, 93.05; 335/270, 274

[56] References Cited

U.S. PATENT DOCUMENTS 4,498,791 2/1985 Gilbert ..... 400/124
4,513,496 4/1985 Wang ..... 400/124 X
4,539,905 9/1985 Zenner ..... 400/124 X

FOREIGN PATENT DOCUMENTS 2126168 3/1984 United Kingdom ..... 101/93.05

*Primary Examiner*—Paul T. Sewell

*Attorney, Agent, or Firm*—Robert T. Mayer

[57] ABSTRACT

The invention relates to a needle printing head (1) comprising a number of printing units (2). Each printing unit (2) is provided with a spring (9) supporting an armature (6) and a printing needle (10). The armature (6) is included in a magnetic field path comprising both a permanent magnet (4) and an electromagnet (7) provided with a core (8). Each spring (9) has one rigidly fastened end and one freely swinging end. According to prior art needle printing heads, the springs are so fixed that essentially the hole bending takes place in one single point in direct connection to the rigidly fastened end. This puts high requirements upon the spring material and the risk of material fatigue is great. According to the invention the bending of the spring (9) does not take place in one signal point, but it distributed along at least a first length adjacent to the fastening point. This distributed fastening is obtained by means of a supporting means (5.1) disposed on the side of the spring facing the electromagnet between the fastening point and an end of the core of the exciting coil (8) disposed in connection to the armature (6).

2 Claims, 1 Drawing Sheet

NEEDLE PRINTING HEAD

The invention relates to a needle printing head comprising a number of printing elements each consisting of a printing needle and an armature fixed to a flat spring, a permanent magnet, and an electromagnet consisting of an exciting coil provided with a core, the armature together with the core of the exciting coil and the permanent magnet and possible further magnetic field conducting elements being included in a magnetic field path, the flat spring in one of its ends being fixed between a first contact surface situated on the side of the spring facing the electromagnet and a second contact surface situated on the opposite side of the spring, the other end of the spring supporting the printing needle being freely movable between a printing position and a rest position, the armature fixed to the flat spring in the rest position resting upon the core of the electromagnet, a supporting means being disposed on the side of the spring facing the electromagnet in a position between the first contact surface and an end of the core of the exciting coil disposed which cooperates with the armature.

Such a needle printing head is previously known from GB-A-2126168. During the non-active condition of the needles the permanent magnet provided for each separate needle keeps the armature in a drawn position. When activating the needle, the magnetic field from the electromagnet being activated thereby, neutralizes the magnetic field from the permanent magnet. Hereby the armature passes a neutral position and the needle performs a printing movement.

The spring supporting the armature and the printing needle are subjected to very great bending stresses at the edge of the contact surfaces during the printing movements. Accordingly, there is a risk that the spring is fatigued at the edge of the contact surface. The fatigue may lead to a breaking off of the spring leading to an operating break down and expensive services.

One object of the invention is to provide a needle printing head having a spring fastening which effectively contributes to the prevention of the fatigue of the spring. Another object of the invention is to obtain a smaller air-gap between the armature and the fastening of the spring. In order to obtain the objects, the needle printing head according to the invention is characterized in that the spring during all of its movement between the rest position and the printing position is pretensioned in one single direction and that the spring all the time is in direct contact with the supporting means and slidingly rests upon the supporting means during its movement between said two positions so that the spring shows a curve shaped section between the contact surfaces and the supporting means. The consequence of the fastening is that the spring is subjected to a softer and a more distributed bending movement and does not pass a neutral tension position.

Figure 1:
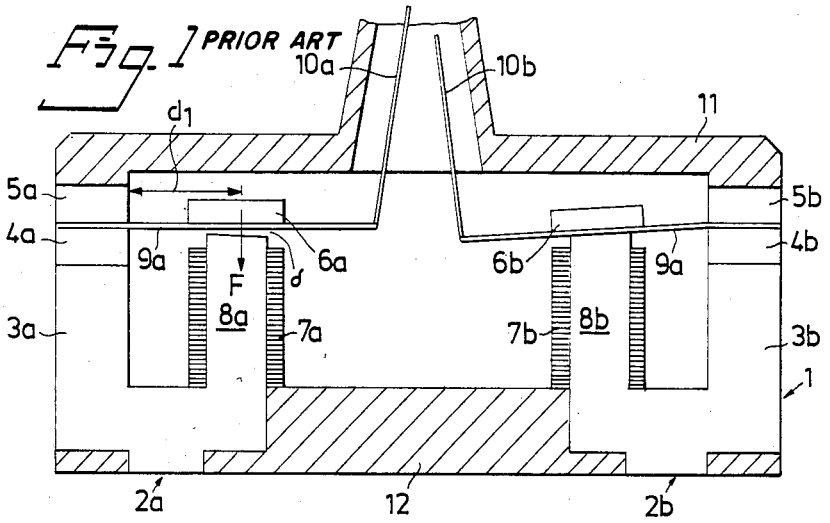
Fig. 1 PRIOR ART
Figure 2:
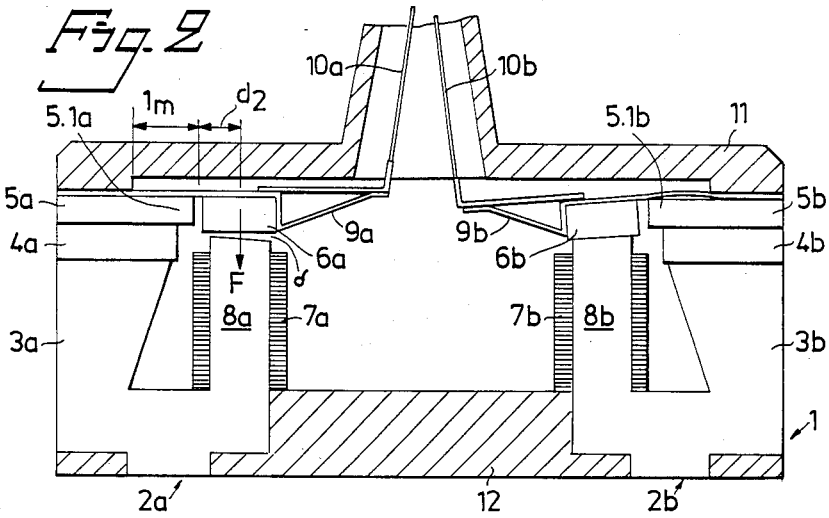
Figure 3:
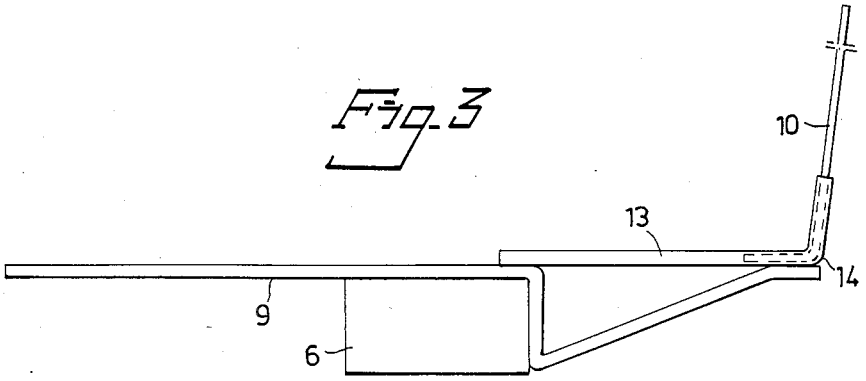

The invention will be described in more detail below with reference to the accompanying drawings in which FIG. 1 shows a cross section of a prior art needle printing head showing one non-activated and one activated printing unit, FIG. 2 shows a cross section view of a needle printing head according to the invention showing a non-activated and an activated printing unit, FIG. 3 shows a magnification of the spring provided with an armature and a needle.

The needle printing heads 1 according to FIGS. 1 and 2 consist of a number of printing units disposed in an essentially circular configuration, two diametrically opposite printing units 2*a*, 2*b* being shown in more detail in the Figures. Each printing unit consists of an iron core 3*a*, 3*b*, a permanent magnet 4*a*, 4*b*, a metal plate 5*a*, 5*b* and an armature 6*a*, 6*b* forming together a closed path for the magnetic field. The iron core includes a branch, 8*a*, 8*b* provided with a coil 7*a*, 7*b*. The coil together with the branch form an electromagnet. A spring 9*a*, 9*b* supports the armature 6*a*, 6*b* and the printing needle 10*a*, 10*b*. The printing units 2*a*, 2*b* are disposed between a front plate 11 and a bottom plate 12.

According to FIG. 1 showing prior art, the spring 9*a*, 9*b* in one of its ends is fastened between two contact surfaces belonging to the permanent magnet 4*a*, 4*b* and the metal plate 5*a*, 5*b*, respectively. The contact surfaces are arranged exactly above each other. A comparatively large air-gap exists here between the armature and the fastening of the spring. The extension of the armature is limited because of weight reasons. When the printing element is in a non-activated condition, see printing element to the right, the permanent magnet keeps the spring drawn against the iron core. By activation of the electromagnet so that it generates a field directed opposite the permanent magnetic field, the armature moves and the preloaded spring provided with the printing needle is moved in a direction towards the printing position, see the printing element to the left. When the activation of the electromagnet ceases, the spring provided with the armature is again drawn towards the iron core by means of the permanent magnet. The principle part of the spring bending during the above described process takes place at the ends of the contact surfaces, where the spring passes from a rigidly fastened to a freely hanging condition.

In the needle printing head according to FIG. 2, the permanent magnet and the electromagnet operates in the way described with reference to FIG. 1. The spring 9*a*, 9*b* is here in one of its ends fastened between two contact surfaces belonging to the metal plate 5*a*, 5*b* and a front plate 11. A supporting means 5.1*a*, 5.1*b* is disposed in the prolongation of the contact surface situated on the armature side of the spring, which supporting means belongs to the metal plate 5*a*, 5*b* in the direction towards the free swinging end of the spring 9*a*, 9*b*. The supporting means in this case consists of a supporting surface directly connected to the first contact surface. The air-gap between the armature 6*a*, 6*b* and the supporting means 5.1*a*, 5.1*b* of the spring fastening is small and consitute a transition which is easy to pass for the magnetic field. The supporting means causes the spring to be bent in the way shown in FIG. 2, in which the left printing unit 2*a* is in an activated condition while the right printing unit 2*b* is in a non-activated condition. It is apparent from FIG. 2 that the spring 9*a*, 9*b* slidingly rests against the supporting means, the supporting means being shaped as a prolongation of the metal plate 5*a*, 5*b*. According to the non-activated printing unit shown to the right, the permanent magnet 4*b* keeps the spring 9*b* pretensioned against the branch 8*b* via the armature 6*b*. In this non-activated condition (i.e. unactivated electromagnet and hence no printing) the spring 9*b* forms a curve between the edge of the front plate 11 and the edge of the metal plate 5*a* at the same time as the spring slidingly rests against the edge of the metal plate. When the electromagnet is activated, the needle passes to the position shown for the activated left printing unit 2a. In its movement between the shown condition, the needle 10 performs a bending which is very indulgent to the spring. The indulgent bending is in the first place due to the fact that the deflection movement of the spring is distributed along a larger section of the spring than before, i.e. in the first place the section between the fastening of the spring and the edge of the metal plate.

According to the prior art embodiment shown in FIG. 1, the force F acting in the air-gap 5 between the armature and the branch has a relatively long moment arm ($d_1$, FIG. 1) and the spring gets its maximum stress at the fastening. The moment of the known embodiment may be written $M=F.d_1$. In order to be able to print with a given maximum frequency, enough power has to be stored in the spring, so that the needle gets the required speed. The energy in the spring may be expressed as the product of the applied moment and the angle of the spring bending. As the force in the air-gap and the length of the air-gap normally are given, there only remains to change the geometry of the spring and/or operating way in order to get the movement desired in the spring. An increase of the thickness of the spring increases the maximum stress in the spring and is not desirable. If however, the spring is loaded with essentially the same movement over its whole length, the spring material is utilized in a better way. This is what happens in the needle printing head according to the invention. According to the embodiment of the invention the moment approximately may be written $M=F.d_2$, in which F is the force in the air-gap acting on the armature and $d_2$ is the moment arm of the force. As $d_2<d_1$, compare FIGS. 1 and 2, it hold that $Fd_2<Fd_1$. The same moment here acts along the whole bending length $1_m$ of the spring. Due to the fact that essentially the same moment exists along a great part of the spring, the spring material may be utilized more effective. Accordingly, the spring may be loaded with a stronger force without exeeding the maximum admittable stress.

FIG. 3 in a larger scale shows the spring 9 provided with the armature 6 and the needle 10 in a side view. An advantageous embodiment of the spring has the bending shown in FIG. 3. The armature 6 is fixed on the underside of the spring 9 adjacent to a bending of 90°. A bent tube 13 is applied between the bending of 90° and the free end of the spring. Before the tube was bent a needle 10 was inserted in the tube and brought past the bending point 14 which is later formed on the tube. When being bent the tube and the needle form a strong connection, and the tube and needle connection is then mounted on the spring.

What is claimed is:

1. A needle printing head comprising a number of printing elements each consisting of a printing needle and an armature fixed to a flat spring, a permanent magnet, and an electromagnet consisting of an exciting coil provided with a core, the armature together with the core of the exciting coil and the permanent magnet being included in a magnetic field path, the flat spring in one of its ends being fixed between a first contact surface situated on the side of the spring facing the electromagnet and a second contact surface situated on the opposite side of the spring, the other end of the spring supporting the printing needle being freely movable between a printing position and a rest position, the armature fixed to the flat spring in the rest position resting upon the core of the electromagnet, a supporting means being disposed on the side of the spring facing the electromagnet in a position between the first contact surface and an end of the core of the exciting coil which cooperates with the armature, characterized in that the spring during all of its movement between the rest position and the printing position is pretensioned in one single direction and that the spring all the time is in direct contact with the supporting means and slidingly rests upon the supporting means during its movement between said two positions so that the spring shows a curve shaped section between the contact surfaces and the supporting means.

2. A needle printing head as claimed in claim 1, characterized in that the supporting means consists of a supporting surface in direct connection to the first contact surface.

* * * * *